US007445568B1

(12) United States Patent
Steffensmeier

(10) Patent No.: US 7,445,568 B1
(45) Date of Patent: Nov. 4, 2008

(54) VOLLEYBALL TRAINING DEVICE

(76) Inventor: David J. Steffensmeier, 801 Avenue F, Fort Madison, IA (US) 52627

( * ) Notice: Subject to any disclaimer, the term of this patent is extended or adjusted under 35 U.S.C. 154(b) by 0 days.

(21) Appl. No.: 11/892,721

(22) Filed: Aug. 27, 2007

(51) Int. Cl.
*A63B 69/00* (2006.01)

(52) U.S. Cl. ..... 473/430; 473/459

(58) Field of Classification Search ..... 473/459, 473/473, 423, 430, 447, 449
See application file for complete search history.

(56) References Cited

U.S. PATENT DOCUMENTS

| | | | | |
|---|---|---|---|---|
| 3,351,343 | A | 11/1967 | Papp | |
| 4,161,313 | A * | 7/1979 | Dickey | 473/449 |
| 4,372,561 | A | 2/1983 | Morgan et al. | |
| 4,881,742 | A * | 11/1989 | Hargreave | 473/575 |
| 4,948,150 | A * | 8/1990 | Daly et al. | 473/430 |
| 5,338,026 | A * | 8/1994 | Kregel | 473/147 |
| 5,575,481 | A * | 11/1996 | Lovetere et al. | 473/430 |
| 5,792,014 | A | 8/1998 | Brown | |
| 5,823,895 | A | 10/1998 | Rasic | |
| 5,916,046 | A * | 6/1999 | Allred et al. | 473/430 |
| 6,672,979 | B2 | 1/2004 | Brenneisen | |
| 6,790,150 | B1 | 9/2004 | Moss et al. | |
| 7,041,016 | B1 | 5/2006 | Omtvedt | |

* cited by examiner

*Primary Examiner*—Raleigh W. Chiu
(74) *Attorney, Agent, or Firm*—Jacobson Holman PLLC

(57) ABSTRACT

A volleyball training device is made of six tubes that are connected to form a shape of the letter "H". A larger 24 inch by 1½ inch diameter tube runs horizontally to form the cross-bar of the "H". Two approximately one inch holes are drilled into the horizontally extending tube, 18 inches apart to allow the larger tube to slide up and down on the four tubes that form the two vertical portions of the "H". One of the holes in the horizontally extending tube is located adjacent to one end of the horizontally extending tube. The other hole is spaced from the opposite end of the horizontally extending bar. At the top of the two vertical tubes are two spring clamps. These clamps secure the unit to any standard basketball hoop.

20 Claims, 5 Drawing Sheets

VOLLEYBALL TRAINING DEVICE

FIELD OF THE INVENTION

A simple and affordable apparatus that can be used by a single volleyball player to practice their spiking skills in a driveway, gym, park or any place there is a basketball hoop or other vertically extending support structure.

BACKGROUND OF THE INVENTION

Those who wish to hone their skills in practicing the spiking of a volleyball are often frustrated by a lack of equipment responsive to their needs. Known equipment is often times associated with an existing volleyball playing field including a volleyball net. Other known equipment includes specialized constructions for suspending a volleyball in the air.

While this equipment may serve its intended purpose, the availability and the costs involved are usually prohibitive for those who wish to practice their spiking skills at home.

SUMMARY OF THE INVENTION

Accordingly, there is an overwhelming need to accommodate those individuals who wish to practice volleyball at home with minimal expense. This object is accomplished by the use of a volleyball training device which can easily be associated with any pre-existing basketball hoop or other vertically extending support structure to which the volleyball training device of the present invention can be secured.

The device of the present invention is made of five tubes that are connected to form a shape of the letter "H". A larger 24 inch by 1½ inch diameter tube runs horizontally to form the crossbar of the "H". Two approximately one inch holes are drilled into the horizontally extending tube, 18 inches apart to allow the larger tube to slide up and down on the four tubes that form the two vertical portions of the "H".

One of the holes in the horizontally extending tube is located adjacent to one end of the horizontally extending tube. The other hole is spaced from the opposite end of the horizontally extending bar.

At the top of the two vertical tubes are two spring clamps. These clamps secure the unit to any standard basketball hoop. The two vertical tubes and thus the spring clamps are spaced 18 inches apart, as is the width of a basketball hoop.

The two vertical tubes are each formed of two stacked tubes, each 30 inches in length. The upper tube has an approximately ¾ inch diameter. A 30 inch long, ⅝ inch diameter lower tube slides into the bottom of the ¾ inch diameter upper tube for approximately three inches. The lower tube is secured in the upper tube by screws. These two stacked tubes, along with two other identical stacked tubes, form the two vertical sides of the "H". Alternatively, the two sets of stacked tubes are each connected by a coupling.

The horizontal tube is 24 inches long and thus protrudes six inches on one side from the vertical tubes that are spaced 18 inches apart. At the end of the horizontal tube, that protrudes six inches from the vertical tube, is mounted a 3¾ inch rubber suction cup. This cup has the same curvature as a volleyball. The cup is lined with a hook portion of a hook and loop material or VELCRO.

The length of the vertical tubes is such that, when suspended from a basketball hoop, the lower most end of the tubes is located spaced above the ground. The spacing of the ends of the vertical tubes above the ground provides a clearance for a volleyball player to approach and spike the volleyball without interference from the vertically extending tubes, while allowing a choice from a plurality of heights of the volleyball spaced above the ground.

Two 27 inch by ¾ inch wide loop straps are wrapped around and secured to the volleyball. This creates the loop material portion of the hook and loop fastener. The loop straps cross each other at two intersections on the face of the ball and face outwardly on four sides of the ball. Attached at one intersection of the two loop straps is one end of a ¼ inch wide by 9 foot long piece of elastic string. At the other end of the elastic string is a small clip. The clip is secured to a basketball hoop or other support structure to tether the volleyball for retrieval.

The larger horizontal tube with the attached hook lined suction cup moves up and down along the vertically extending tubes from 9 feet, 10 inches to 5 feet, 4 inches above the ground to provide a proper set height to accommodate virtually all heights of volleyball players. A volleyball player can thereby practice their spiking skills at various height levels.

To use the present invention, the two clamps at the top of the two vertical tubes are attached to any standard basketball hoop located at an elevation of ten feet above the ground. The horizontal tube is slid up or down to a desired set height. Two additional clamps are placed beneath the horizontal tube on the vertical tubes to hold the horizontal tube in position.

The small clip attached at the end of the nine feet of elastic string is secured to either the basketball hoop or net as a ball retrieval system. The loop strip on the volleyball is placed into the hook lined suction cup.

To practice spiking the volleyball, the ball is hit. The elastic string is thereby allowed to stretch. The ball will be easily retrieved because the ball can only travel as far as an extension of the elastic string, which returns to its at rest length to return the ball. The ball is placed again onto the cup and the spiking practice is repeated.

Accordingly, it is another object of the present invention to provide a volleyball training device which is mounted on a basketball hoop by two vertically extending tubes interconnected by a horizontally extending tube.

It is yet another object of the present invention to provide a volleyball training device which is mounted on a basketball hoop by two vertically extending tubes interconnected by a horizontally extending tube, with the horizontally extending tube being slidably mounted on the two vertically extending tubes, and having a holder cooperating with a volleyball to maintain a desired height of the volleyball above the ground.

It is still yet another object of the present invention to provide a volleyball training device which is mounted on a basketball hoop by two vertically extending tubes interconnected by a horizontally extending tube, with the horizontally extending tube being slidably mounted on the two vertically extending tubes, and having a holder cooperating with a volleyball to maintain a desired height of the volleyball above the ground, with the ball connected by an elastic string to the basketball hoop structure for retrieval of the ball after the ball has been spiked.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the volleyball training device disclosed herein, and are for illustrative purposes only. Other embodiments that are substantially similar can use other components that have a different appearance.

DETAILED DESCRIPTION OF THE PREFERRED EMBODIMENTS

Figure 1:
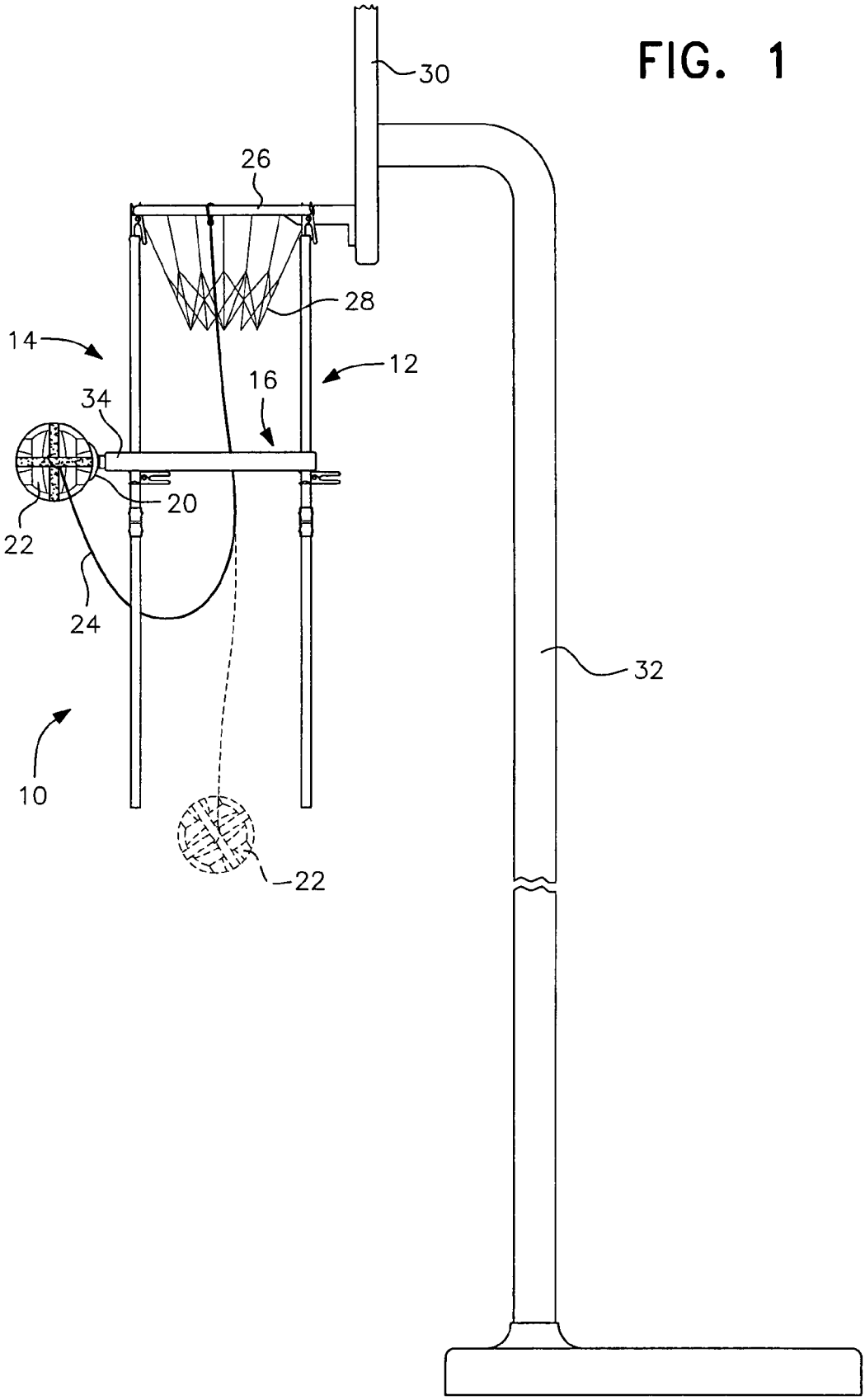
FIG. 1 illustrates the volleyball training device of the present invention mounted on a basketball hoop supported above the ground with the volleyball illustrated in dotted lines being retrieved after having been spiked.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
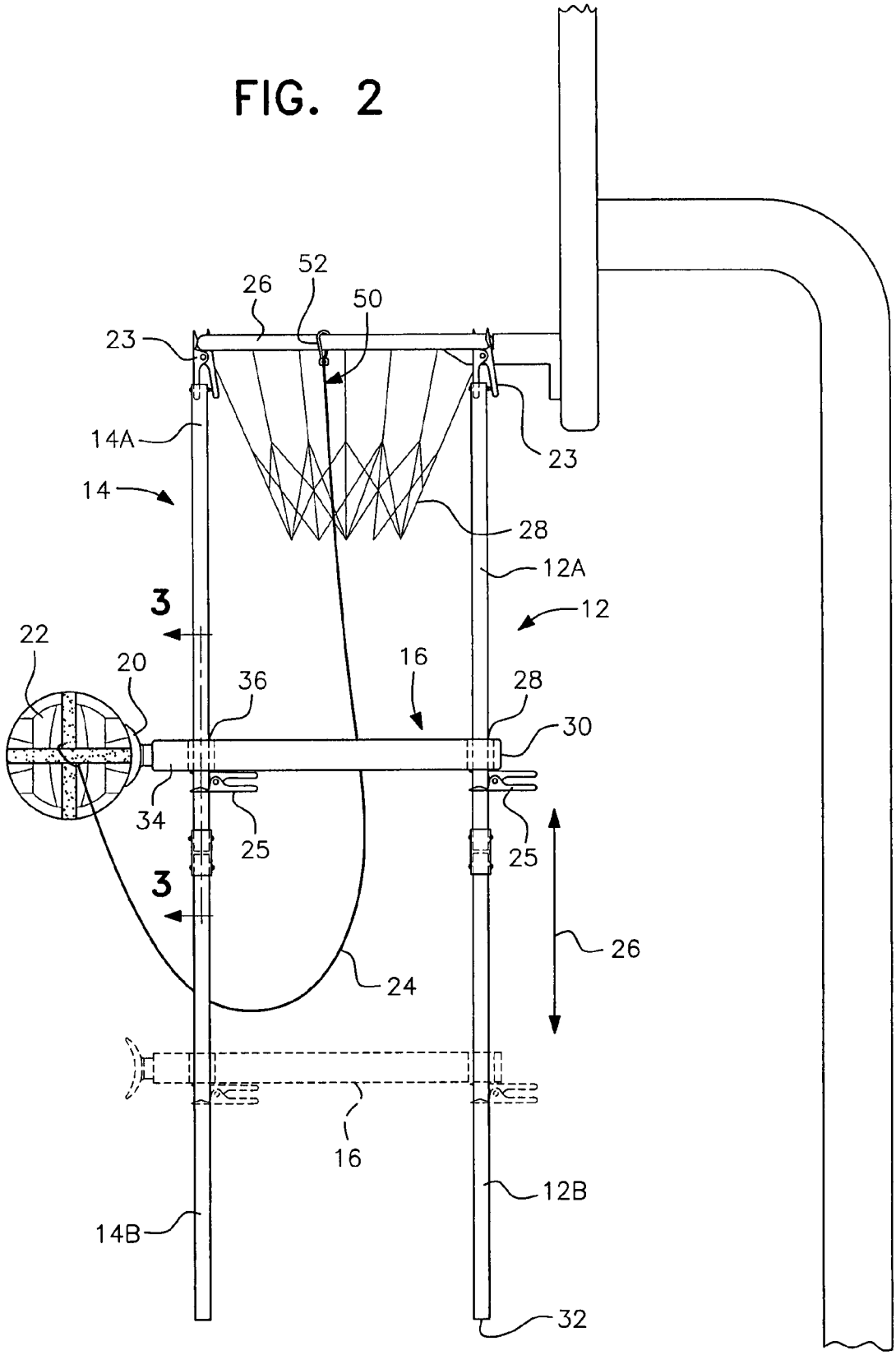
FIG. 2 is an enlarged, detailed view of the volleyball training device of the present invention with a horizontally extending tube illustrated in one of the plurality of alternate spaced positions of the horizontally extending tube on the vertically extending tubes, so as to vary the height of the volleyball positioned for spiking practice.

With reference to the drawings, in general, and to FIGS. 1 and 2, in particular, a volleyball training device embodying the teachings of the subject invention is generally designated as 10. With reference to its orientation in FIG. 1, the volleyball training device includes two vertically extending tubes 12 and 14. Slidably mounted on the two vertically extending tubes is a horizontally extending tube 16. At a free end 34 of tube 16 is located a suction cup curved holder 20 for holding a volleyball 22 in position.

An elastic string 24 extends between the volleyball and a hoop 26 or a net 28 of a basketball goal. The hoop and net are supported by a backboard 30 and a support pole 32 such that the hoop 26 is normally located ten feet above the ground.

Figure 3:
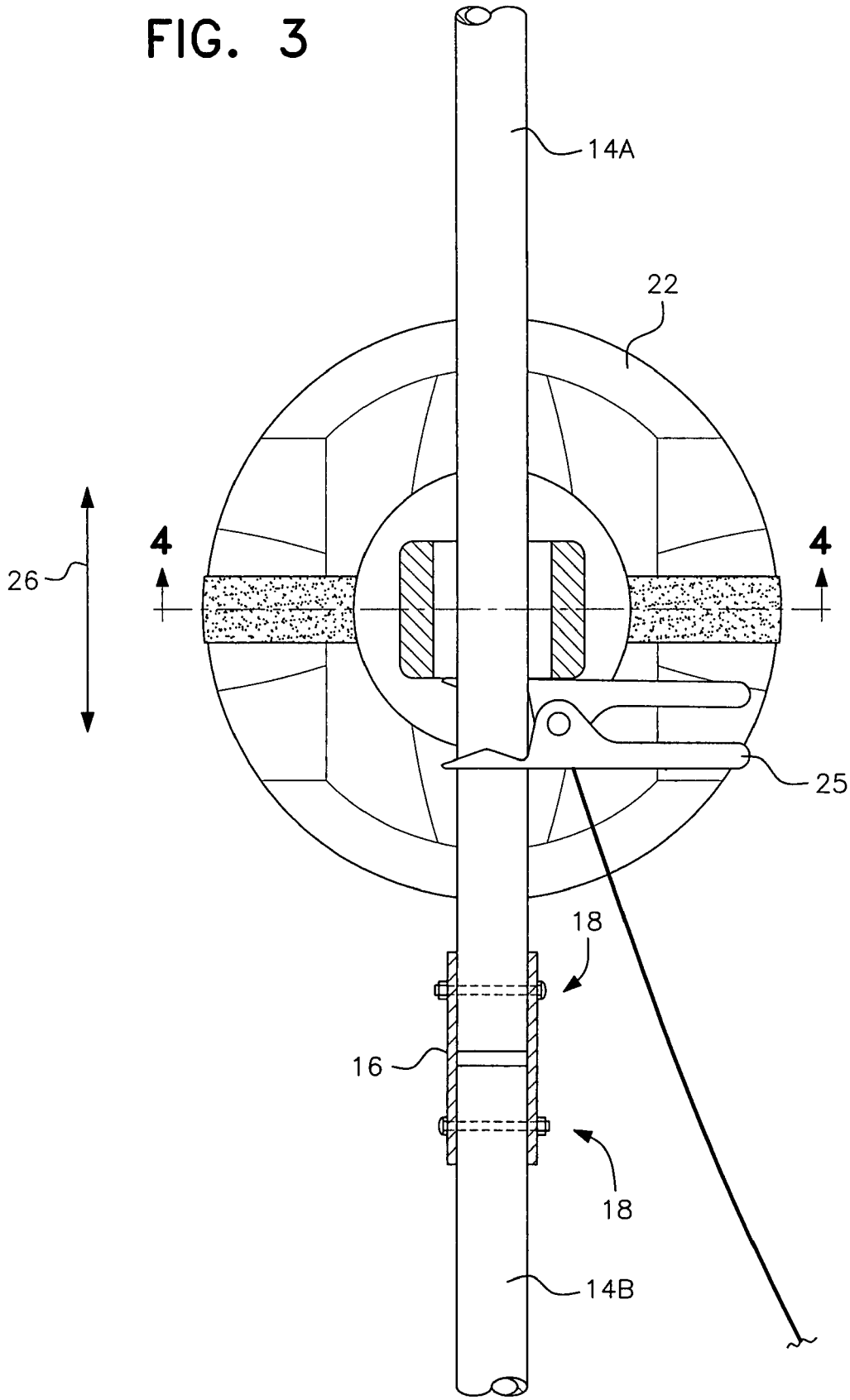
FIG. 3 is an enlarged, sectional view taken along line 3-3 of FIG. 2 to illustrate the mounting of the horizontally extending tube on the vertically extending tube and the interconnection of two vertically extending tube portions.
Figure 3A:
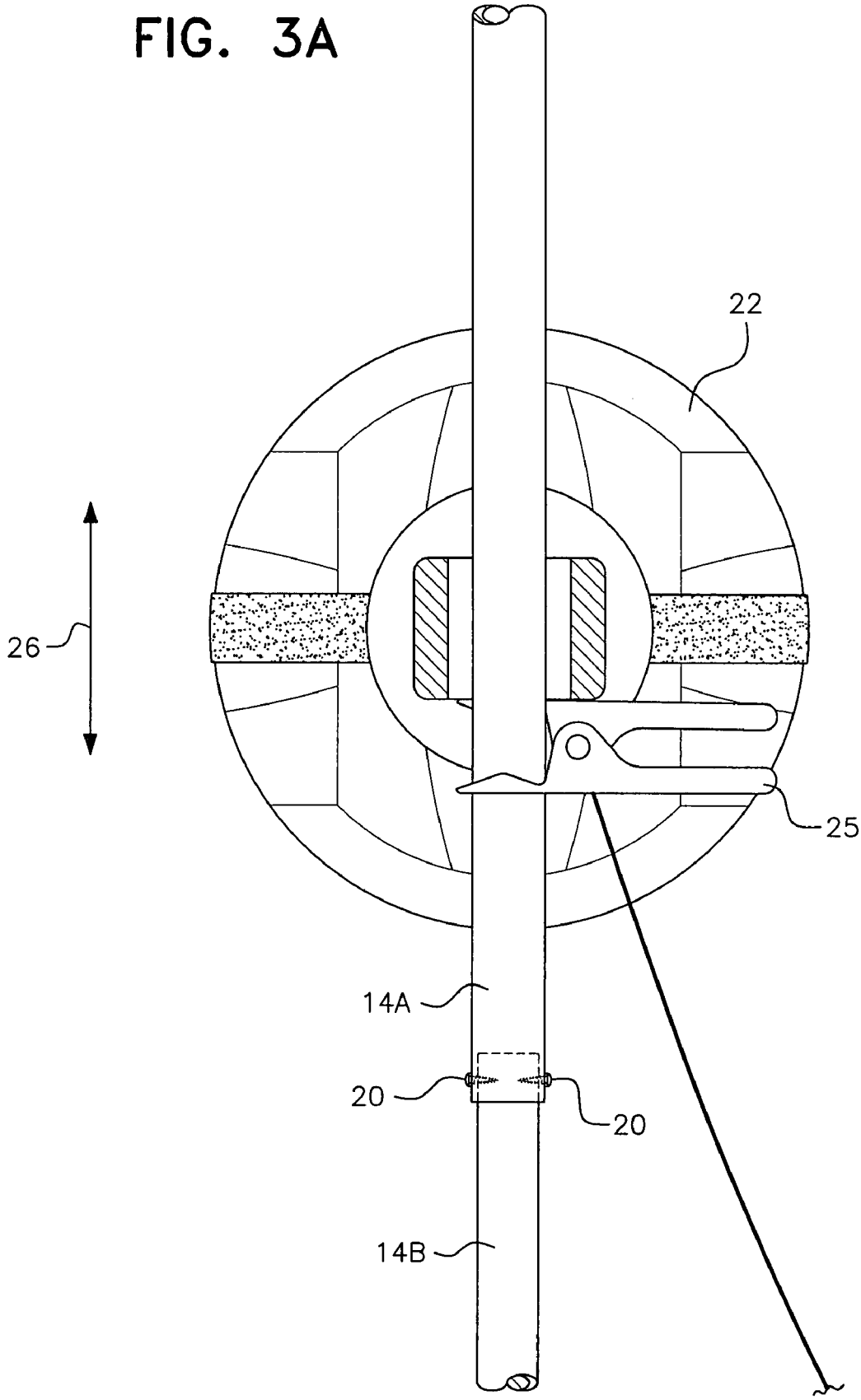
FIG. 3A is an alternate embodiment for the interconnection of two tube portions forming the vertically extending tube.

As shown in greater detail in FIG. 2, each of the vertically extending poles 12, 14 include two pieces of tubing 12A, 12B and 14A, 14B, respectively. The tube sections are connected by a coupling 16 and bolt assemblies 18 as shown in FIG. 3 or, in an alternative embodiment, by varying the diameter of the tube sections 14A, 14B, as shown in FIG. 3A, the upper tube portion 14A houses an uppermost portion of the lower tube section 14B. The two tube sections are interconnected by set screws 20.

Returning to FIG. 2, at an uppermost end of each of the two vertically extending tubes 12, 14 is located a clamp 23 for securing the vertically extending tubes to a basketball hoop. In addition, two clamps 25 are used to maintain the position of the horizontally extending tube 16 at one of a plurality of locations along a height of the vertically extending tubes 12, 14 as indicated by arrow 26 and illustrated in dotted lines in FIG. 2.

The horizontally extending tube 16 includes an opening 28 located adjacent to end 30 having a diameter sufficient to allow the sliding of the horizontally extending tube 16 along a length of the vertically extending tube 12 until reaching terminal end 32 of the vertically extending tube 12 which is located spaced above the ground.

At the opposite end 34 of the horizontally extending tube 16 is located an opening 36 to allow the sliding of the horizontally extending tube 16 along a length of the vertically extending tube 14. Opening 36 is spaced six inches from end 34 of the horizontally extending tube 16.

Figure 4:
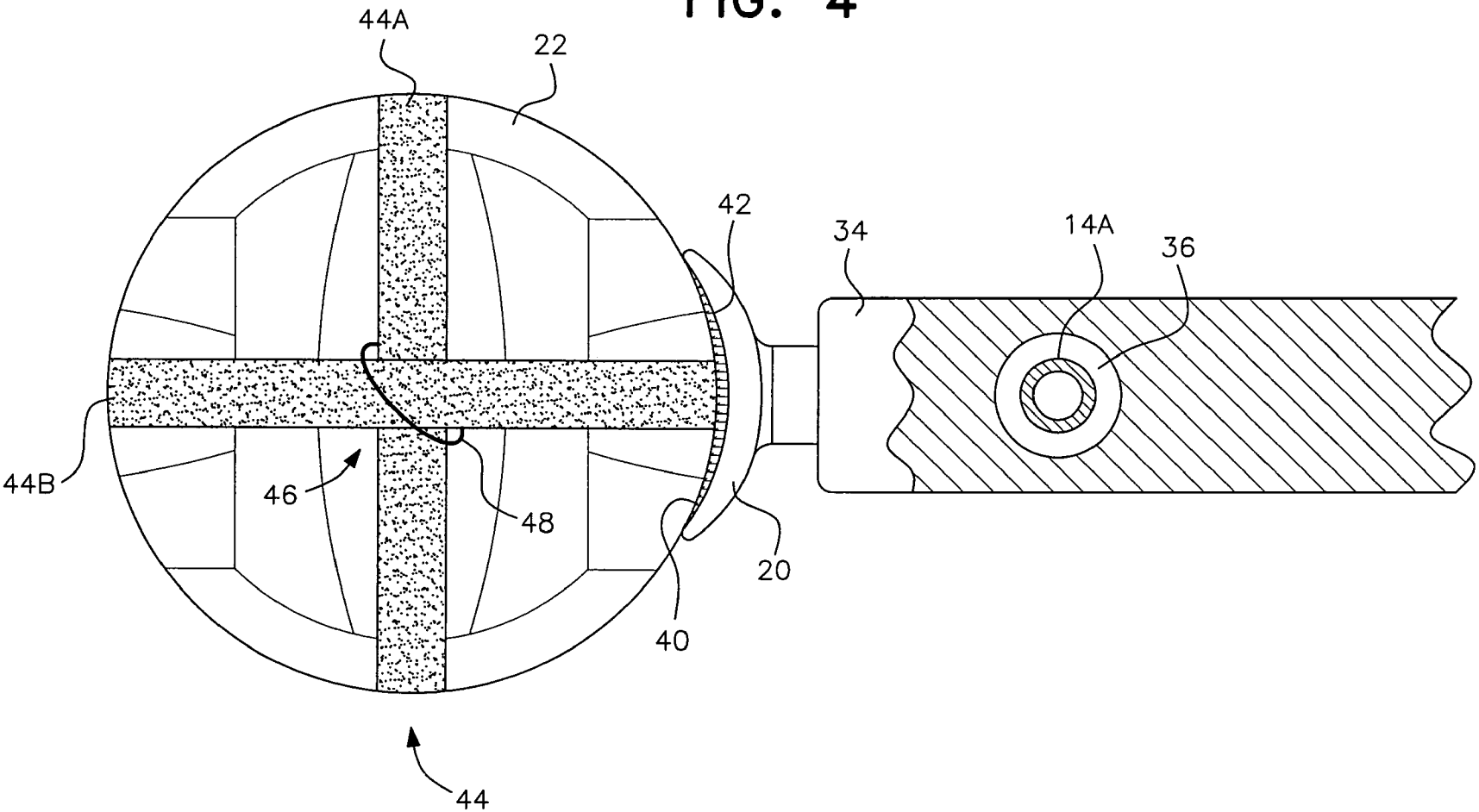
FIG. 4 is a sectional view taken along line 4-4 of FIG. 3 to illustrate the mounting of a volleyball on a free end of the horizontally extending tube and the attachment of an elastic string to an intersection of fastening strips secured to the volleyball.

A volleyball holder 20 is located at end 34 of the horizontally extending tube. As shown in greater detail in FIG. 4, the curvature of the holder 20 approximates the curvature of volleyball 22.

An interior of the concave portion 40 includes one part 42 of a hook and loop fastener. The other part 44 of the hook and loop fastener is formed by two straps 44A and 44B which surround the volleyball 22 and intersect at right angles. At one of the intersections 46, one end 48 of elastic string 24 is anchored. At the opposite end 50 of the elastic string 24, as shown in FIG. 2, is secured a hook 52 to attach the end 50 of the string 24 to the basketball hoop 26 or basketball net 28. This serves as the anchor for the volleyball 22.

Once the volleyball 22 is hit by an individual practicing the spiking of a volleyball, due to the elastic nature of the string 24, the ball 22 will return to the position shown in dotted lines in FIG. 1. The volleyball 22 is then reset in the holder 20 for subsequent practicing of volleyball spiking.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A volleyball training device comprising a vertically extending element, a clamp mounted at an upper end of said vertically extending element for supporting said vertically extending element with a lower end of said vertically extending element above ground level, a crossbar slidably mounted on said vertically extending element and said crossbar being fixable to said vertically extending element at a plurality of locations, a volleyball, and a free end of said crossbar including a holder for the volleyball, the volleyball being removably connected to the holder.

2. The volleyball training device as claimed in claim 1, wherein the volleyball and the holder include hook and loop fasteners.

3. The volleyball training device as claimed in claim 1, wherein the volleyball includes an elongated member, one end of the elongated element is secured to the volleyball and an opposite end of the elongated member includes a clip for anchoring the elongated member.

4. The volleyball training device as claimed in claim 3, wherein the elongated member is elastic.

5. The volleyball training device as claimed in claim 1, further comprising a support member, said clamp of said vertically extending element is secured to said support member.

6. The volleyball training device as claimed in claim 5, wherein said support member is a basketball hoop.

7. The volleyball training device as claimed in claim 6, wherein said basketball hoop is supported by a pole.

8. The volleyball training device as claimed in claim 7, wherein said basketball hoop is supported above ground and the lower end of said vertically extending element terminates above ground level.

9. The volleyball training device as claimed in claim 1, further comprising another vertically extending element with said crossbar slidably mounted on said another vertically extending element and an opening in said crossbar for said vertically extending element is located at one end of said crossbar and another opening in said crossbar for said another vertically extending element is spaced from said free end of said crossbar.

10. The volleyball training device as claimed in claim 1, wherein an opening in said crossbar for said vertically extending element is spaced from free end of said crossbar.

11. A volleyball training device comprising a vertically extending element, a clamp mounted at an upper end of said vertically extending element for supporting said vertically extending element with a lower end of said vertically extending element above ground level, a crossbar slidably mounted on said vertically extending element, another clamp fixing said crossbar to said vertically extending element at a plurality of locations, a volleyball, and a free end of said crossbar including a holder for the volleyball, the volleyball being removably connected to the holder.

12. The volleyball training device as claimed in claim 11, wherein the volleyball and the holder include hook and loop fasteners.

13. The volleyball training device as claimed in claim 11, wherein the volleyball includes an elongated member, one end of the elongated element is secured to the volleyball and an opposite end of the elongated member includes a clip for anchoring the elongated member.

14. The volleyball training device as claimed in claim 13, wherein the elongated member is elastic.

15. The volleyball training device as claimed in claim 11, further comprising a support member, said clamp of said vertically extending element is secured to said support member.

16. The volleyball training device as claimed in claim 15, wherein said support member is a basketball hoop.

17. The volleyball training device as claimed in claim 16, wherein said basketball hoop is supported by a pole.

18. The volleyball training device as claimed in claim 17, wherein said basketball hoop is supported above ground and the lower end of said vertically extending element terminates above ground level.

19. The volleyball training device as claimed in claim 11, further comprising another vertically extending element with said crossbar slidably mounted on said another vertically extending element and an opening in said crossbar for said vertically extending element is located at one end of said crossbar and another opening in said crossbar for said another vertically extending element is spaced from said free end of said crossbar.

20. The volleyball training device as claimed in claim 11, wherein an opening in said crossbar for said vertically extending element is spaced from free end of said crossbar.

* * * * *